US009568185B2

(12) United States Patent
Embler

(10) Patent No.: US 9,568,185 B2
(45) Date of Patent: Feb. 14, 2017

(54) LIGHTING FIXTURE FOR TRANSPARENT OR TRANSLUCENT MATERIAL

(71) Applicant: John William Embler, Oakland Park, FL (US)

(72) Inventor: John William Embler, Oakland Park, FL (US)

( * ) Notice: Subject to any disclaimer, the term of this patent is extended or adjusted under 35 U.S.C. 154(b) by 84 days.

(21) Appl. No.: 14/803,961

(22) Filed: Jul. 20, 2015

(65) Prior Publication Data

US 2016/0223168 A1 Aug. 4, 2016

Related U.S. Application Data

(60) Provisional application No. 62/111,473, filed on Feb. 3, 2015.

(51) Int. Cl.

| | |
|---|---|
| ***F21V 33/00*** | (2006.01) |
| ***F21S 9/02*** | (2006.01) |
| ***F21V 21/096*** | (2006.01) |
| *F21S 8/00* | (2006.01) |

(52) U.S. Cl.

CPC ..... *F21V 33/006* (2013.01); *F21S 9/02* (2013.01); *F21V 21/096* (2013.01); *F21S 8/03* (2013.01); *F21Y 2105/10* (2016.08); *F21Y 2115/10* (2016.08)

(58) Field of Classification Search

CPC ..... F21V 33/006; F21V 21/096; F21V 17/10; F21V 17/105; F21V 21/08; F21V 17/00; F21V 19/00; F21V 19/001; F21V 21/00; F21V 21/0965; F21S 9/02; F21S 8/03; F21Y 2105/10; F21Y 2115/10

See application file for complete search history.

(56) References Cited

U.S. PATENT DOCUMENTS

| | | | | |
|---|---|---|---|---|
| D595,887 | S | 7/2009 | Blom | |
| 7,726,852 | B2 * | 6/2010 | Sanoner | F21V 21/096 135/16 |
| 7,824,055 | B2 | 11/2010 | Sherman | |
| 8,651,711 | B2 * | 2/2014 | Rudisill | H05K 3/325 362/249.02 |
| 2014/0254136 | A1 | 9/2014 | Oraw et al. | |

FOREIGN PATENT DOCUMENTS

DE 10 2009 025 548 A1 12/2010

* cited by examiner

*Primary Examiner* — Bao Q Truong
(74) *Attorney, Agent, or Firm* — Kenneth R. Rice

(57) ABSTRACT

A lighting fixture that can be mounted on a transparent or translucent shelf using magnetic attraction between the light fixture and a matching keeper placed on the opposite surface of the shelf. The lighting fixture has a magnetic or ferrous edge that is held in place by a keeper with a similar magnetic or ferrous component.

16 Claims, 2 Drawing Sheets

LIGHTING FIXTURE FOR TRANSPARENT OR TRANSLUCENT MATERIAL

BACKGROUND OF THE INVENTION

This invention relates, in general, to a lighting fixture that will provide illumination for items displayed on a shelf made of a transparent or translucent material. The light from the lighting fixture passes through the transparent or translucent material to which the fixture is attached to illuminate an item displayed on the transparent or translucent material.

Magnets or ferrous materials are incorporated into or attached to a lighting fixture. An object containing ferrous material or magnets is placed on one side of the transparent or translucent material. The lighting fixture is placed on the other side of the transparent or translucent material. The lighting fixture and object are held in place on either side of the transparent or translucent material by the magnetic attraction between the lighting fixture and the object. The light emitted by the lighting fixture passes through transparent or translucent material to illuminate an item displayed on the transparent or transparent material. If the transparent or translucent material is magnetic or ferrous, the magnetic or ferrous object may not be required.

DESCRIPTION OF THE PRIOR ART

In the prior art various types of devices have been proposed.

U.S. Pat. No. 7,824,055, issued to Sherman, for a Shelf Light Assembly. Sherman discloses a shelf light that is mounted to the edge of the shelf.

U.S. Patent Application No. 2014/0254136, filed by Oraw et al. for an LED Shelf Light For Product Display Cases. Oraw et al. discloses a shelf light that is mounted to the edge of the shelf.

U.S. Pat. No. D595,887, issued to Blom, for a Combined Light And Shelf Blom discloses a light embedded in a shelf.

German Patent No. DE102009025548, issued to Sauter, for a Lighting Device For Interior Lighting Of A Translucent Container From Outside show a light that is attached to a glass wall by suction or glue.

SUMMARY OF THE INVENTION

The present invention is directed to a lighting fixture to be mounted on a transparent or translucent shelf or other object.

It is an object of the present invention to provide a new and improved light fixture that is quickly mounted to a transparent or translucent shelf.

It is an object of the present invention to provide a new and improved light fixture that is removably mounted to a transparent or translucent shelf.

It is an object of the present invention to provide a new and improved light fixture that is easily repositioned on a transparent or translucent shelf.

These and other objects and advantages of the present invention will be fully apparent from the following description, when taken in connection with the annexed drawings.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
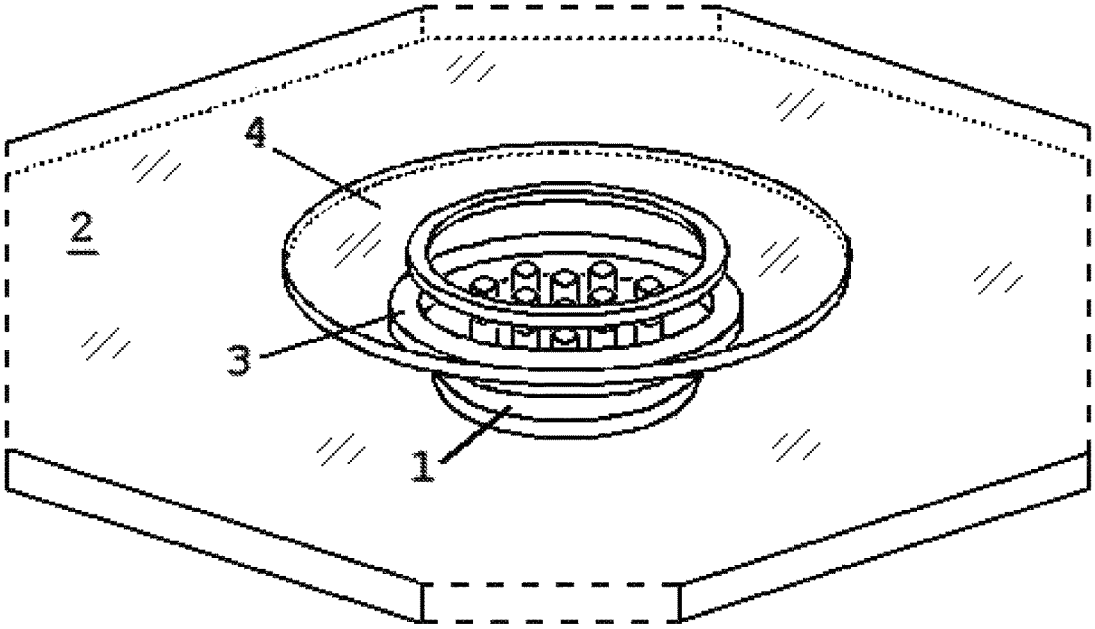
FIG. 1 shows the lighting fixture and keeper installed on a shelf.

Referring now to the drawings in greater detail, FIG. 1 shows the lighting fixture 1 installed on a transparent shelf 2. The lighting fixture 1 has a magnet or ferrous material 3 around the upper edge of the lightning fixture 1. The lighting fixture 1 is placed beneath the shelf 2. A keeper 4 with an embedded magnet or ferrous material 5 is placed on top of the shelf opposite the lighting fixture 1. The magnetic attraction between the magnet or ferrous material in the lighting fixture 1 and keeper 4 hold them in place on the shelf.

Figure 2:
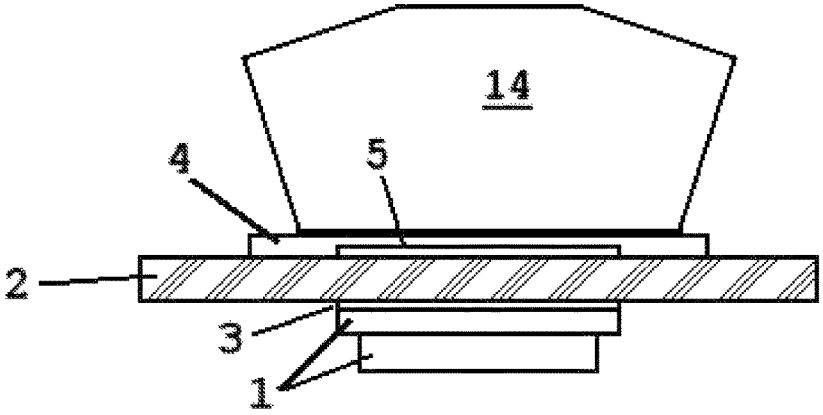
FIG. 2 shows side view of the lighting fixture and keeper installed on a shelf.

FIG. 2 shows a side view of the lighting fixture 1 installed on a transparent shelf 2. The lighting fixture 1 has a magnet or ferrous material 3 around the upper edge of the lightning fixture 1. The lighting fixture 1 is placed beneath the shelf 2. A keeper 4 with an embedded magnet or ferrous material 5 is placed on top of the shelf opposite the lighting fixture 1. The magnetic attraction between the magnet or ferrous material in the lighting fixture 1 and keeper 4 hold them in place on the shelf. An item 14 is displayed on top of the keeper 4.

Figure 3:
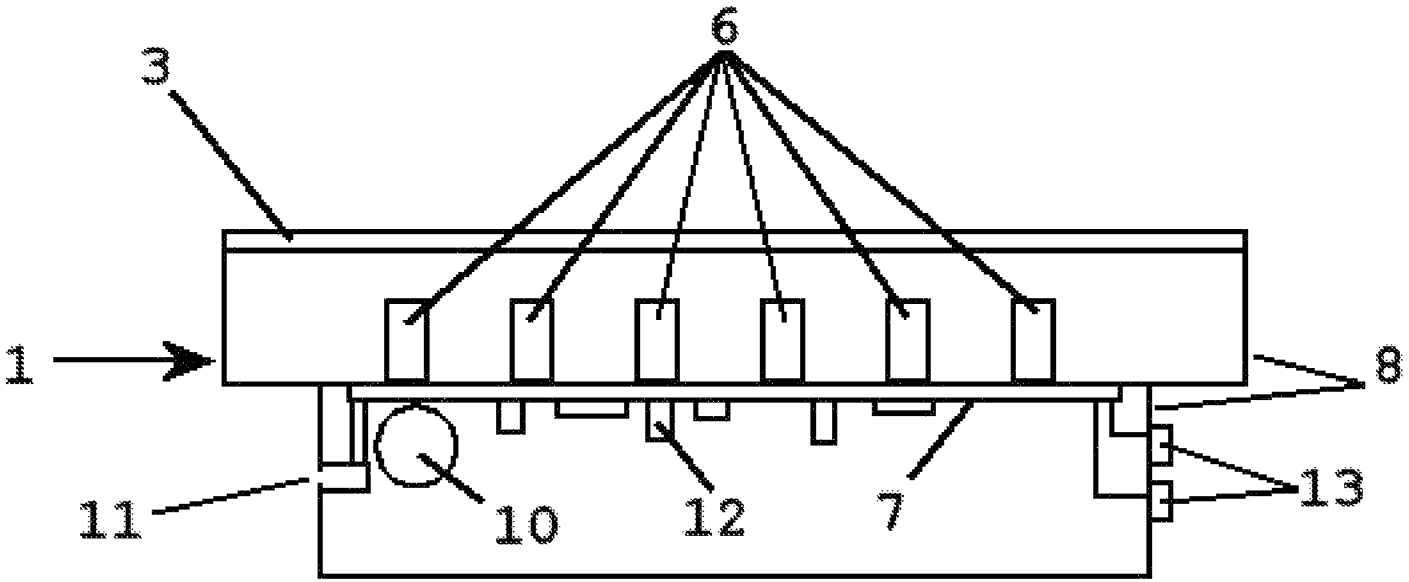
FIG. 3 shows a cross section view of the lighting fixture.

FIG. 3 shows a cross section of the lighting fixture 1. The lighting fixture 1 has a number of LED elements 6 mounted on a circuit board 7 positioned inside a base 8. The magnet or ferrous material 3 forms the upper edge of the base. The base 8 has a lower portion 9 which opens to provide access to one or more batteries 10. The batteries 10 may be either disposable or rechargeable batteries. A charging port 11 for rechargeable batteries may also be provided. The rechargeable batteries may also be recharged by inductive charging. The circuit board 7 may optionally have circuitry 12 and controls 13 to control the LED elements to provide features such as dimming, varying light patterns and timed lighting. The circuitry could also be remotely controlled and/or programmable, sound or motion activated. Multiple lights could be programmed simultaneously. Such circuitry is old and well known in the art.

Although the lighting fixture 1 is shown as being round, it could take many shapes such as a matching shape for the item 14 being illuminated. The lighting fixture 1 could be square or hexagonal shaped to allow it to be grouped in multiples under larger items 14.

Although LED elements 6 are disclosed as a best mode, other lighting elements such as incandescent bulbs, halogen bulbs, photo luminescent materials, glow lights and others may also be used.

The magnet and ferrous material provided on the lighting fixture 1 and keeper 3 may be provide in several configurations. The lighting fixture 1 can have a magnet and the keeper ferrous material. The lighting fixture 1 can have the ferrous material and the keeper 3 the magnet. The lighting fixture 1 and the keeper 3 can both have magnets, which their poles suitably aligned.

The lighting fixture 1 may also be made in small sizes which could be used on clothing to illuminate wearable items such as jewelry and other decorations, such as seasonal images.

If the item 14 on the shelf 2 being illuminated by the lighting fixture 1 is made of a ferrous material, or has a magnetic material embedded in or mounted to it, the lighting fixture 1 with a magnet 3 in the upper edge of the base 8 may be used without the matching keeper. The magnet 3 in the lighting fixture would be held in place by being attracted to the ferrous item being illuminated.

Although the LIGHTING FIXTURE FOR TRANSPARENT OR TRANSLUCENT MATERIAL and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A lighting fixture comprising:

a base with an opening, said opening having an edge;

at least one lighting element mounted inside said base;

magnetic elements mounted on said edge of said opening;

a transparent keeper, said keeper containing one of magnetic and ferrous elements;

wherein said base is placed on one side of an object made of one of a transparent material and a translucent material and said keeper is placed on the opposite side of said object, the magnetic attraction between said base and said keeper maintaining the position of said lighting fixture on said object.

2. A lighting fixture as described in claim 1 wherein said object is a shelf.

3. A lighting fixture as described in claim 1 wherein said object is a fabric.

4. A lighting fixture as described in claim 1 wherein said at least one lighting element is a LED light.

5. A lighting fixture as described in claim 1 wherein said at least one lighting element is a halogen light.

6. A lighting fixture as described in claim 1 wherein said at least one lighting element is made of photo luminescent materials.

7. A lighting fixture as described in claim 1 wherein said keeper is a display item which is illuminated by said at least one lighting element.

8. A lighting fixture as described in claim 1 wherein said at least one lighting element is powered by one of a rechargeable battery and a non-rechargeable battery.

9. A lighting fixture comprising:

a base with an opening, said opening having an edge;

at least one lighting element mounted inside said base;

a first one of magnetic and ferrous elements mounted on said edge of said opening;

a transparent keeper, said keeper containing a second one of magnetic and ferrous elements;

said first and second one of magnetic and ferrous elements arranged in one configuration selected from the following group of configurations:

a. said opening has magnetic elements and said keeper has magnetic elements;

b. said opening has magnetic elements and said keeper has ferrous elements;

c. said opening has ferrous elements and said keeper has magnetic elements;

wherein said base is placed on one side of an object made of one of a transparent material and a translucent material and said keeper is placed on the opposite side of said object, the magnetic attraction between said base and said keeper maintaining the position of said lighting fixture on said object.

10. A lighting fixture as described in claim 9 wherein said object is a shelf.

11. A lighting fixture as described in claim 9 wherein said object is a fabric.

12. A lighting fixture as described in claim 9 wherein said at least one lighting element is a LED light.

13. A lighting fixture as described in claim 9 wherein said at least one lighting element is a halogen light.

14. A lighting fixture as described in claim 9 wherein said at least one lighting element is made of photo luminescent materials.

15. A lighting fixture as described in claim 9 wherein said keeper is a display item which is illuminated by said at least one lighting element.

16. A lighting fixture as described in claim 9 wherein said at least one lighting element is powered by one of a rechargeable battery and a non-rechargeable battery.

* * * * *